United States Patent [19]

Ghigliotti et al.

[11] 4,447,108

[45] May 8, 1984

[54] SOCKET MEMBER FOR AN ELECTRICAL CONNECTOR

[75] Inventors: Giovanni Ghigliotti; Attilio Lancella, both of Genova-Sestri, Italy

[73] Assignee: Connei S.p.A., Genvoa-Sestri, Italy

[21] Appl. No.: 354,448

[22] Filed: Mar. 3, 1982

[30] Foreign Application Priority Data

Mar. 16, 1981 [IT] Italy ..... 12468 A/81
Jun. 26, 1981 [IT] Italy ..... 12561 A/81

[51] Int. Cl.[3] ..... H01R 13/11

[52] U.S. Cl. ..... 339/256 RT; 339/258 R; 339/258 RR

[58] Field of Search ..... 339/256 R, 256 RT, 258 R, 339/258 A, 258 RR, 258 T

[56] References Cited

U.S. PATENT DOCUMENTS

| | | | |
|---|---|---|---|
| 1,833,145 | 11/1931 | Wilhelm | 339/276 R |
| 2,450,529 | 10/1948 | Sprigg | 29/155.55 |
| 3,141,723 | 7/1964 | Bonhomme | 339/256 R |
| 3,314,044 | 3/1967 | Powell | 339/256 R |
| 4,203,647 | 5/1980 | Bonhomme | 339/256 R |

FOREIGN PATENT DOCUMENTS

| | | | |
|---|---|---|---|
| 110194 | 7/1928 | Austria . | |
| 932565 | 9/1955 | Fed. Rep. of Germany | 339/258 RR |
| 881186 | 4/1943 | France . | |
| 80247 | 8/1961 | France . | |
| 1281826 | 12/1961 | France | 339/258 RR |
| 1274578 | 9/1969 | France | 339/256 R |
| 604272 | 5/1960 | Italy . | |
| 1029907 | 5/1966 | United Kingdom . | |
| 855967 | 3/1975 | U.S.S.R. . | |

*Primary Examiner*—John McQuade
*Assistant Examiner*—Paula Austin
*Attorney, Agent, or Firm*—King and Liles

[57] ABSTRACT

The socket member for electrical connectors is obtained thanks to permanent deformation by twisting of a cylindrical sleeve of suitable metal, provided with through slots (2) arranged on its cylindrical surface and inclined with respect to the longitudinal axis of the sleeve. Each slot, previously to its twisting deformation, presents a transverse profile with sides (102, 202) diverging towards the exterior, and said sides meet at the ends of the slot forming curvilinear edges (302, 402) in such a manner that the vertices of said edges located on the inner surface of the sleeve are nearer to each other with respect to the vertices of the edges located on the outer surface, which are farther from each other. The particular shape of the slots contributes in a determining manner to the correct deformation upon twisting of the sleeve, so that the strips defined by the slots tend to be arranged according to a family of straight generatrices of a hyperboloid of one sheet, taking in consideration the composite stresses of traction-compression and torsion which take place precisely upon twisting of the sleeve. In this manner there is avoided the formation of irregularities, such as sharp edges or warped surfaces, in the areas of contact at the interior of the thus formed socket.

10 Claims, 10 Drawing Figures

SOCKET MEMBER FOR AN ELECTRICAL CONNECTOR

BACKGROUND AND SUMMARY OF THE INVENTION

The present invention has for its object a socket member for electrical connectors of the pin and socket type, and the method for making same.

More particularly the socket member object of the present invention is of the type in which its inner areas which establish the contact with the pin member are, when the said pin member is not inserted, arranged at least approximately according to a family of straight generatrices of a hyperboloid of one sheet. In this manner, upon insertion of the pin member into the socket member, the said inner contact areas of the socket come to elastically bear against the surface of the pin member, thus ensuring an efficient electrical contact between the said two members of the connector.

A socket member of this type is known, for example, from the Italian Pat. No. 604 272 (Bonhomme) according to which the socket presents at its interior a plurality of contact wires, arranged according to straight generatrices of a hyperoboloyd. The contact wires are secured at the interior of the socket so as to be tensioned between a pair of coaxial circumferences and are blocked onto a cylindrical sleeve, which constitutes the body of the socket, by means of two locking rings force-fitted onto the extremities of said sleeve. The socket according to the mentioned Italian Pat. No. 604 272, although it presents excellent features of electrical contact between the socket and the pin, is rather complex in its construction and consequently requires for its making particular methods and devices, and this obviously leads to a high cost of the final product.

According to U.S. Pat. No. 2,450,529 (Sprigg) a socket member is obtained by cutting opposite sides of a cylindrical sleeve to form two slots extending in planes diagonally disposed with respect to each other, and by reducing the diameter of the sleeve bore by turning one end of the slotted socket with respect to the other end. However the slots are cut so as to present parallel flanks or sides, which leads to irregularities in the deformation upon twisting of the slotted socket, particularly in the areas of contact between socket and pin, with consequent difficulty of insertion, jamming and deterioration of the pin member, and malfunctioning of the connector.

The socket member according to the present invention is obtained thanks to permanent deformation by twisting of a cylindrical sleeve of suitable metal, provided with through slots arranged on its cylindrical surface and inclined with respect to the longitudinal axis of the sleeve. The characterizing feature resides in the fact each slot, previously to its twisting deformation, presents a transverse profile with sides diverging towards the exterior, and some sides meet at the ends of the slot forming curvilinear edges in such a manner that the vertices of said edges located on the inner surface of the sleeve are nearer to each other with respect to the vertices of the edges located on the outer surface, which are farther from each other. The said particular shape of the slots contributes in a determining manner to the correct deformation upon twisting of the sleeve, so that the strips defined by the slots tend to be arranged according to a family of straight generatrices of a hyperboloid of one sheet, taking in consideration the composite stresses of traction-compression and torsion which take place precisely upon twisting of the sleeve. In this manner there is avoided the formation of irregularities, such as sharp edges or warped surfaces, in the areas of contact at the interior of the thus formed socket.

According to another characteristic feature of the invention, it has been found that an angle of inclination of the slots between 5° and 20° (and preferably between 8° and 10°) is particularly advantageous.

Still according to another feature of the invention, it has been found that, by selectively reducing the thickness of the cylindrical wall of the sleeve at one zone, it is possible to select the positioning of the zone of maximum reduction of the diameter of the sleeve (upon twisting) and consequently the positioning of the areas of contact for the pin member.

The invention also relates to a method for the making of a socket member for electrical connectors of the above mentioned type, comprising the following basic steps:

- obtaining a cylindrical sleeve of any suitable metal, presenting an inner axial bore having a diameter which is equal or smaller than the final diameter;
- cutting, by means of a double-angle milling cutter, of through slots arranged along the cylindrical surface of the sleeve and inclined with respect to the longitudinal axis of the sleeve;
- finish boring and grinding of the inner surface up to the required final diameter, if necessary;
- twisting of the slotted sleeve of a predetermined angle, in the same direction as the inclination of the slots.

BRIEF DESCRIPTION OF THE DRAWINGS

The above and other features of the invention, and the advantages deriving therefrom, will appear evident from the following description of some preferred embodiments thereof, made with reference to the attached drawings.

In the drawings.

DESCRIPTION OF THE PREFERRED EMBODIMENT

Figure 1:
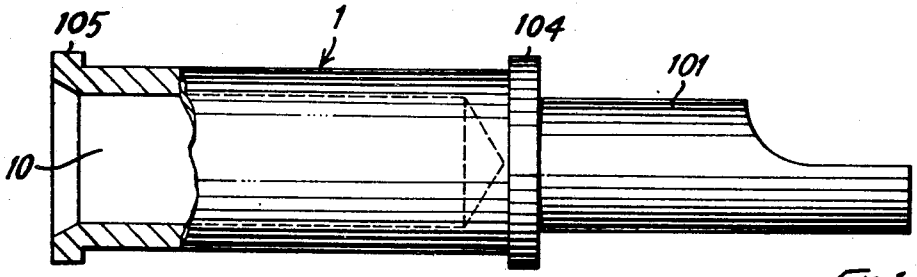
FIG. 1 is a side view, with parts in section, of the cylindrical sleeve from which the socket member is obtained.

In FIG. 1 there is shown the socket member 1 intended to be the female element of an electrical connector. The said socket member 1 is obtained starting from a solid bar which is subjected to machine tool operations. More precisely, a bore 10 is made in said bar, the bore 10 being suitably flared outwardly at its inlet, so as to define a rectangular circular cylindrical sleeve closed at one end or base. In correspondence with the end or base portions of the cylinrical sleeve, which define the annular zones or "rings" 4 and 5, there can be obtained, by machining, the two annular projections 104 and 105 which have the purpose of strengthening the ends of the sleeve, and more particularly of the inlet end defined by the annular zone 5 (as it will be seen after). The female or socket member 1 presents moreover a hollow appendix 101 which also is obtained by suitable machining on the extension of the annular zone 4 opposite to the inlet end, the said appendix 101 serving for the connection (in a known manner) with the terminal of an electrical cable (not shown). Obviously, the shape and size of said appendix 101 for the connection with the electric circuit can be modified in any known manner which can be easily conceived by a person skilled in the art, depending upon the required connection. The sleeve 1 is made of any suitable conductive matal, such as for example any brass alloy normally used in components for electric conduction.

Figure 2:
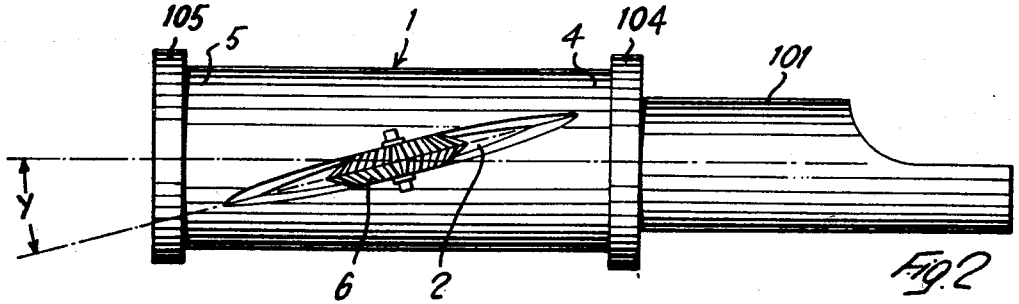
FIG. 2 is a side view of the cylindrical sleeve during the cutting of a slot.

On the cylindrical wall of the sleeve 1 there are obtained a plurality of slots 2 arranged along the whole circumference and preferably angularly equispaced. In FIG. 2 there is illustrated a preferred method for obtaining said slots 2. More precisely, the slots 2 are obtaining by machining, with the aid of a double-angle milling cutter 6.

Figure 3:
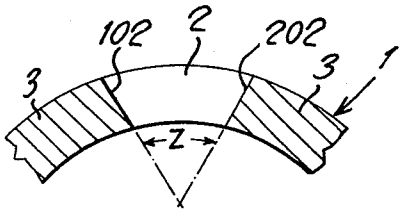
FIG. 3 is a detail of a transverse section of slot.

Preferably, as it appears from FIG. 3, the double-angle cutter 6 is of the equal-angle type, and the angle formed by the two cutting edges, which angle is indicated by the reference letter Z, is comprised between 30° and 70° and preferably is of about 60°. Obviously, also double unequal-angle cutters can be employed.

Still with reference to FIG. 2, the plane of rotation of the cutter 6 is perpendicular to the plane which is tangent to the outer cylindrical surface of the sleeve 1 in correspondence with the center of the slot 2, and forms a predetermined angle Y with the plane containing the longitudinal axis of the sleeve 1 and the generatrix of the outer cylindrical surface which is lying in the above mentioned plane tangent to the said outer cylindrical surface. The said angle Y, or angle of inclination of the milling cutter 6, is comprised between 5° and 20° and preferably between 8° and 10°.

Figure 4:
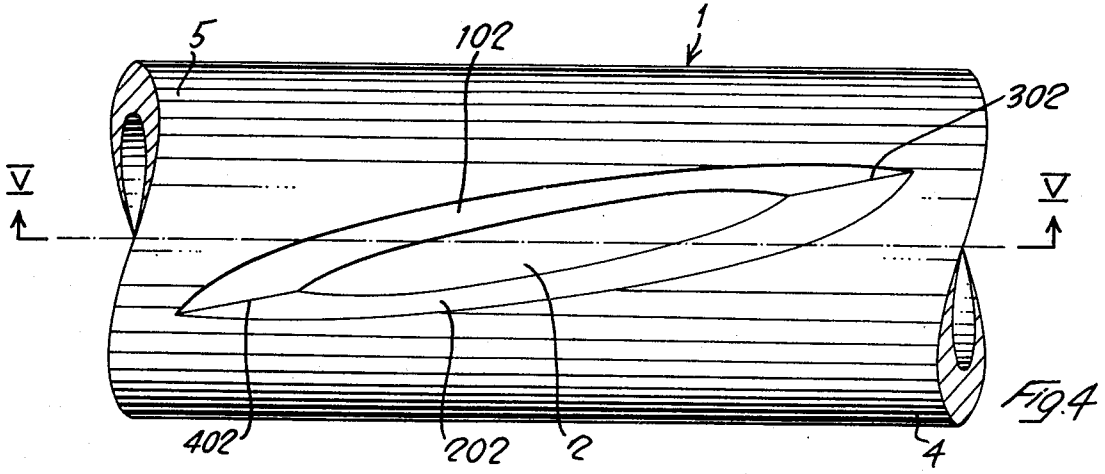
FIG. 4 is a view, in enlarged scale, of a detail showing the shape of the slot.
Figure 5:
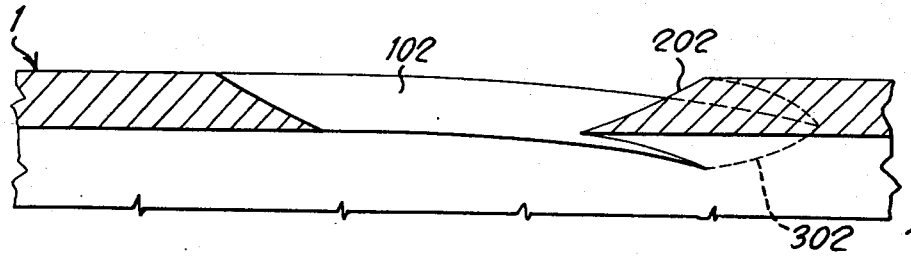
FIG. 5 is a view according to line V—V of FIG. 4.

The slot 2 is obtained by causing the milling cutter 6 to perform a predetermined and limited travel in such a manner that the slot 2 terminates at a certain distance from the ends of the cylindrical sleeve, thus defining the two end rings 4 and 5 which, in the illustrated embodiment, are provided with the annular projections 104 and 105. In order to avoid that the two sides of the slot 2 present (particularly in the middle zone) surfaces parallel to each other, the cutting depth of the cutter 6 must be kept inferior than the radial height of the cutting edges of the cutter itself. By operating in such a manner, on the cylindrical sleeve 1 there are obtained the slots 2 which present a geometrical profile as illustrated in FIGS. 4 and 5. The said geometrical profile is defined by two flanks or sides 102 and 202 which are inclined and open outwardly, and which come to meet each other in correspondence with the ends of the slot 2 thus forming two edges 302 and 402 having a curvilinear path, in which the vertices of the said edges 302 and 402 which are located on the inner cylindrical surface of the sleeve are nearer to each other, while the vertices of the said edges which are located on the outer cylindrical surface of the sleeve are farther from each other.

In the case that the sleeve 1 presents a constant section or thickness, the sides 102 and 202 of the slots 2 present a surface which is equal but symmetrically arranged with respect to an axis passing through the center of the slot and perpendicular to the longitudinal axis of the sleeve, in such a manner that the edges 302 and 402 alternately separate larger and smaller areas. This leads to the formation of different strength sections of the strips between the slots 2 at either side of the edges 302 and 402, thus pre-arranging the whole structure in a more favourable manner to resist the opposite compressive and tensile stresses which will originate upon twisting of the sleeve, as it will be described later.

Figure 6:
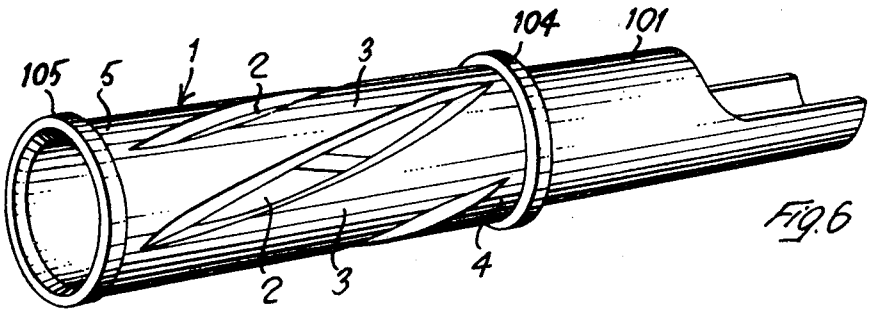
FIG. 6 shows, in perspective view, a sleeve provided with slots prior to the twisting operation.

In FIG. 6 there is shown a sleeve 1 provided with a plurality of slots 2 obtained in the above described manner, suitably angularly equispaced along the cylindrical wall of the sleeve itself. In this manner, the slots 2 define between each other a plurality of strips 3, which are inclined with respect to the longitudinal axis of the sleeve of the same inclination angle Y as the slots 2.

Figure 7:
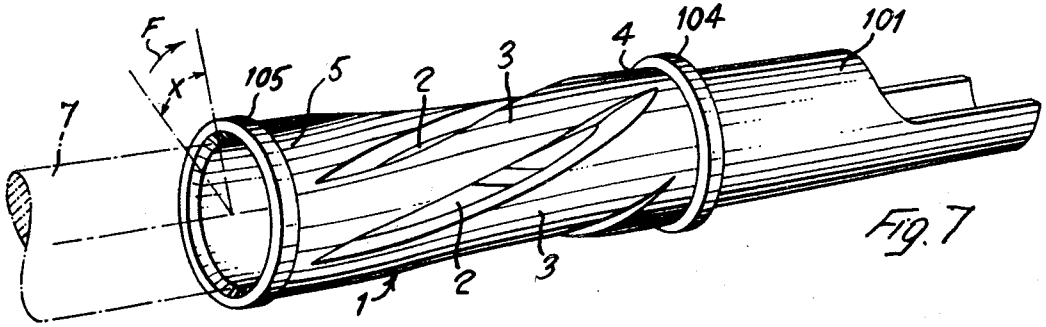
FIG. 7 is a perspective view similar to FIG. 6, showing the sleeve after the twisting operation.

The thus obtained sleeve, presenting the slots 2, is subsequently subjected to a twisting operation, by mechanically effecting a relative rotation (arrow F) according to a predetermined angle X, between the two end rings, as shown in FIG. 7, in the direction of inclination of the slots 2. The torque applied along the sleeve axis must be such as to cause a permanent deformation of the sleeve itself beyond the elastic limit, while the strips 3 tend to arrange themselves according to a family of straight generatrices of a hyperboloid of one sheet. In fact, by considering the situations of the connections of the strips 3 to the end rings 4 and 5, at the moment of the twisting operation, in the said strips 3 there will be determined a composite situation of traction-compression and twisting. Consequently, there will be originated zones with tensioned fibres and zones with compressed fibres, but as a whole there will be obtained, as above said, a deformation of the strips 3 in such a manner that said strips will tend at least approximately to arrange themselves according to a family of generatrices of a hyperboloid of one sheet, and in this manner there will be formed a zone of progressive diameter reduction in corresondence of the central portion of the cylindrical sleeve, between the two end rings 4 and 5. The peculiar shape of the slots 2, as above described with reference to FIGS. 2, 3, 4 and 5, contributes in a determining manner to a correct deformation as desired.

It now appears evident that the sleeve socket 1 can receive a pin contact member 7 (male element) the cross section of which must have any diameter comprised between the maximum inlet diameter (corresponding to the inner diameter of the inlet end ring 5 of the socket) and the minimum diameter defined by the above mentioned zone of reduction of the diameter. The arrangement of the inner surfaces of the strips 3 will be such that they will present, upon insertion of the pin member 7, a bearing or contact surface between the two members (socket and pin) very wide and consequently a good section for the passage of the electric current.

As a consequence of the insertion of the pin member 7 into the socket member, the strips 3 will be deformed elastically in correspondence with the zones of contact with the pin member itself, said zones being determined by the extension of the median zone of diameter reduction comprised between the two inner diameters corresponding, at both sides of the diameter of maximum reduction, to the outer diameter of the pin member 7. Moreover, the insertion of the pin member promotes a slight elastic deformation of the sleeve in a direction opposed to the twist direction which was previously applied in order to obtain the permanent deformation of the sleeve, i.e. a slight relative rotary movement between the two end rings 4 and 5, in a direction contrary to the twisting rotation according to FIG. 7. Said elastic deformation in a contrary direction ensures a smoother insertion of the pin member 7 and consequently a lesser wear of the two members (pin and socket) of the connector.

Figure 8:
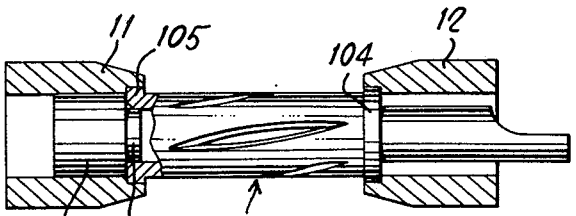
FIG. 8 shows diagrammatically a device for twisting the slotted sleeve.

With reference to FIG. 8, a device for twisting the socket 1 provided with slots 2 is diagrammatically illustrated. The said device comprises basically two chucks 11 and 12 arranged one opposite to the other and capable of effecting a relative axial rotation, and designed to grip the end rings 5 and 4 of the socket or sleeve 1 (together with the respective annular projections 105 and 104). In correspondence with the free inlet end 5 of the sleeve, there is arranged a suitable contrast mandrel 13 which carries a short forward appendix 113 having a diameter substantially equal to the inner diameter of the inlet defined by ring 5. In this manner, at the moment of the gripping and twisting effected by chuck 11, there is avoided the squeezing of ring 5 and of the inlet opening defined by same. The annular projections 104 and 105 have the function of strengthening the ends of the sleeve during the said gripping and twisting operation. As above said, the appendix 113 of the contrast mandrel 13 is very short, and in any case it must not be prolonged into the interior of the socket or sleeve 1 to such an extent as to interfere with the process of reduction of the diameter consequent to the twisting operation.

A typical method of making a socket member for an electrical connector of the above specified type will comprise therefore the following operational steps:

(1) Lathe machining of the sleeve, starting from solid bar, with terminal portions which are different depending upon the actual requirements (connection with printed circuits, connection with electric cables, etc).

(2) Axial boring of the sleeve, so as to obtain the bore 10. Said bore presents a diameter which is smaller than the final diameter.

(3) Cutting of the slots 2 by means of double equal-angle cutter suitably shaped.

(4) Finish boring of the inner bore up to the final diameter, with simultaneous elimination of the inner burrs of the slots 2.

(5) Polishing or grinding down of the inner surface of the bore.

(6) Twisting of the sleeve according to a predetermined angle X (see FIG. 6).

(7) If desired or required, plating of the finished piece. In this connection, it must be noted that the presence of the slots 2 consents a better penetration of the liquid for the electrochemical treatment at the interior of the socket, thus ensuring a better uniformity of deposition of the protective layer on the whole surface of the socket member.

The socket member can be also obtained starting from blanks cut from a metal sheet, and in this case the above mentioned steps 1 and 2 are substituted with the following:

(1A) Punching of the blank from a flat metal sheet and subsequent shaping (by rolling) until there has been obtained the sleeve already provided with the inner bore, suitable means and/or operations (welding, etc.) being obviously provided in order to avoid the radial opening of the thus obtained sleeve.

The sleeve can be also obtained starting from a continuous pipe, which is subsequently cut according to predetermined lengths.

In the case that the socket is made starting from a solid rod, the cutting of the slots by means of the milling cutter can be effected prior to the axial boring of the piece.

It is to be noted, moreover, that apart from the galvanic treatment mentioned at the above point 7) the sleeve or socket, prior to and/or subsequently to the above described steps can be subjected to any whatsoever thermic, chemical or mechanical treatment which is deemed necessary or useful in consideration of the material being employed (metal or alloy).

Figure 9:
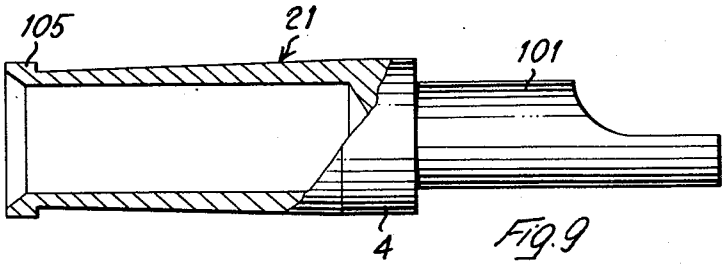
FIG. 9 is a side view, with parts in section, of a modified embodiment showing a sleeve with wall having a non-uniform thickness, resulting into an outer conical profile.
Figure 10:
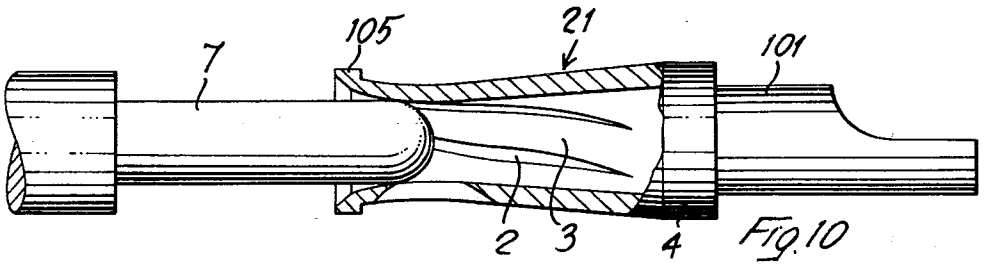
FIG. 10 is a view similar to FIG. 9, after the twisting operation, and showing also the pin member during its insertion.

With further reference to FIGS. 9 and 10, another preferred embodiment of the socket member according to the present invention is illustrated, in which, by obtaining a zone of smaller thickness of the cylindrical sleeve forming the socket, it is possible to modify accordingly the positioning of the zone of maximum diameter reduction along the length of the sleeve itself. More particularly, prior to the twisting operation, there is obtained a sleeve 21 (see FIG. 9) which is substantially equal to the sleeve shown in FIG. 1, except that it presents an outer conicity or tapering directed from end ring 4 to end ring 5, in such a manner that the thickness of the sleeve is minimum at the said inlet ring 5. As a consequence of the twisting operation (after having effected all the other required operations, such as cutting of the slots, finish boring and polishing of the bore) the zone of reduced diameter of the sleeve will come to be located in proximity to the inlet ring 5 of the sleeve itself (see FIG. 10). The just now described feature is particularly advantageous in case that it is required (either by construction standards or by functional requirements of the conductor) that the electric contact between the pin member and the socket member must take place not beyond a predetermined length of insertion of the pin member into the socket member.

From the above, it appears evident that the socket member constructed in accordance with the invention presents, among others, the following advantages:

Extreme simplicity of construction, both regarding the object and regarding the mode of making it.

Possibility of employing different conductive materials, while maintaining excellent features of mechanical and electrical functionality.

The said advantages are actually guaranteed in consideration of the fact that, in order to obtain the required characteristic features, the following parameters (separately of jointly) can be taken in consideration:

(a) number of the strips 3 obtained in the sleeve, and corresponding number of the slots 2;

(b) shape of the slots 2;

(c) inclination angle Y of the slots 2 with respect to the axis of the sleeve;

(d) twisting angle adopted for the permanent deformation of the sleeve;
(e) thickness of the strips 3;
(f) length of the strips 3 with respect to the length of the sleeve;
(g) material (metal or alloy) of which the sleeve is made, and thermic, chemical and mechanical treatments which can be effected prior to and/or subsequently to the single operational steps for the making of the socket member.

Concerning the slots 2, said slots can be provided angularly equispaced, or arranged at different angular intervals, and/or be grouped in groups of at least two slots.

It is believed that the invention will have been clearly understood from the detailed description of some preferred embodiments thereof. Changes in the details of construction may be made, without departing from the basic principle of the invention as described above and claimed hereinafter.

We claim:

1. A socket member for pin-and-socket electrical connectors, of the type in which the inner areas of the socket member intended to establish the contact with the pin member are, when the said pin member is not inserted, arranged at least substantially in the shape of a hyperboloid of one sheet, said socket member being obtained by means of permanent deformation by twisting, according to a predetermined angle, of a hollow cylindrical body of a suitable metal provided with through slots arranged along its cylindrical surface and inclined with respect to the longitudinal axis of said cylindrical body, said twisting being directed in the sense of inclination of the slots, wherein the improvement resides in the fact that each slot previously to its twisting deformation, presents sides which diverge towards the exterior of said cylindrical body, and said sides meet at the ends of the slot forming curvilinear edges in such a manner that the vertices of said edges located on the inner surface of the socket member are nearer to each other, with respect to the vertices of the edges located on the outer surface, which are farther from each other.

2. A socket member according to claim 1, in which the sides of each slot, previously to the twisting deformation, form between each other an angle comprised between 30° and 70°.

3. A socket member according to claim 2, in which the angle formed by the sides of the slot is of about 60°.

4. A socket member according to claim 2, in which the sides of the slot are inclined symmetrically with respect to the longitudinal median plane of the slot.

5. A socket member according to claim 2, in which the sides of the slot are inclined asymmetrically with respect to the longitudinal median plane of the slot.

6. A socket member according to claim 1, in which the slots are arranged, previously to the twisting deformation, inclined with respect to the longitudinal axis of the hollow cylindrical body of an angle comprised between 5° and 20°.

7. A socket member according to claim 6, in which the inclination angle of each slot with respect to the longitudinal axis of the hollow cylindrical body is preferably comprised between 8° and 10°.

8. A socket member according to claim 1, in which the hollow cylindrical body presents, at least in the zone intersected by the through slots, a cylindrical wall having a uniform thickness.

9. A socket member according to claim 1, in which the hollow cylindrical body presents, at least in the zone intersected by the through slots, a cylindrical wall having a non-uniform thickness in the longitudinal direction.

10. A socket member according to claim 9, in which the hollow cylindrical body presents at its exterior a conical profile which is converging towards the inlet opening of the socket member itself.

* * * * *